US011581126B2

(12) United States Patent
Yoshioka et al.

(10) Patent No.: US 11,581,126 B2
(45) Date of Patent: Feb. 14, 2023

(54) INDUCTOR COMPONENT

(71) Applicant: Murata Manufacturing Co., Ltd., Kyoto-fu (JP)

(72) Inventors: Yoshimasa Yoshioka, Nagaokakyo (JP); Ryo Kudou, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 464 days.

(21) Appl. No.: 16/777,760

(22) Filed: Jan. 30, 2020

(65) Prior Publication Data

US 2020/0265990 A1 Aug. 20, 2020

(30) Foreign Application Priority Data

Feb. 15, 2019 (JP) ..... JP2019-025519

(51) Int. Cl.
*H01F 27/29* (2006.01)
*H01F 27/32* (2006.01)
*H01F 27/28* (2006.01)

(52) U.S. Cl.
CPC ..... *H01F 27/29* (2013.01); *H01F 27/2823* (2013.01); *H01F 27/324* (2013.01)

(58) Field of Classification Search
CPC ..... H01F 27/29; H01F 27/2823; H01F 27/324
See application file for complete search history.

(56) References Cited

U.S. PATENT DOCUMENTS

2007/0040163 A1* 2/2007 Okuzawa ..... H01F 27/292 257/31
2012/0243143 A1* 9/2012 Iwanaga ..... H01G 4/005 361/301.1
2013/0343023 A1 12/2013 Nakagoshi et al.
2017/0169930 A1* 6/2017 Kudo ..... H01F 17/0013
2018/0075965 A1* 3/2018 Yoshioka ..... H01F 27/292
2018/0294090 A1* 10/2018 Nishikawa ..... H01F 17/0033

FOREIGN PATENT DOCUMENTS

| | | | |
|---|---|---|---|
| CN | 107039144 | A | 8/2017 |
| CN | 107818864 | A | 3/2018 |
| JP | 2012-204441 | A | 10/2012 |
| JP | 2014-007227 | A | 1/2014 |
| JP | 2014-013815 | A | 1/2014 |
| JP | 2018-046051 | A | 3/2018 |

OTHER PUBLICATIONS

An Office Action; "Notice of Reasons for Refusal," mailed by the Japanese Patent Office dated Sep. 21, 2021, which corresponds to Japanese Patent Application No. 2019-025519 and is related to U.S. Appl. no. 16/777,760 with English translation.

* cited by examiner

*Primary Examiner* — Carlos Amaya

(74) *Attorney, Agent, or Firm* — Studebaker & Brackett PC

(57) ABSTRACT

An inductor component includes a multilayer body including a magnetic layer; an inductor wiring disposed inside the multilayer body; and an external terminal exposed from the multilayer body. The multilayer body or the external terminal has an overlapping region disposed on the inductor wiring and a non-overlapping region not in contact with the inductor wiring, and reflection spectra of the overlapping region is different from reflection spectra of the non-overlapping region when irradiated with light having a prescribed wavelength from an outer surface side.

20 Claims, 7 Drawing Sheets

INDUCTOR COMPONENT

CROSS-REFERENCE TO RELATED APPLICATION

This application claims benefit of priority to Japanese Patent Application No. 2019-025519, filed Feb. 15, 2019, the entire content of which is incorporated herein by reference.

BACKGROUND

Technical Field

The present disclosure relates of an inductor component.

Background Art

One known inductor component is described in Japanese Unexamined Patent Application Publication No. 2014-13815. This inductor component includes a multilayer body including a magnetic layer; an inductor wiring disposed inside the multilayer body; and an external terminal exposed from the multilayer body.

SUMMARY

Inductor components are recently being reduced in size, and their external terminals are also being reduced in area. In that case, if the external terminal of the inductor component described above are disposed at positions displaced from their originally-designed positions due to production variations, the external terminals may not be connected to the inductor wiring or the area of contact between the external terminal and the inductor wiring may become excessively small so that electrical connectivity and physical connectivity may be impaired.

Accordingly, the present disclosure provides an inductor component in which a connection position between an inductor wiring and an external terminal can be known after the formation of the external terminal and it can be determined whether the connection between the inductor wiring and the external terminals are impaired.

According to one embodiment of the present disclosure, an inductor component includes a multilayer body including a magnetic layer; an inductor wiring disposed inside the multilayer body; and an external terminal exposed from the multilayer body. The multilayer body or the external terminal has an overlapping region which is disposed on the inductor wiring and a non-overlapping region which is not in contact with the inductor wiring, and reflection spectra of the overlapping region is different from reflection spectra of the non-overlapping region when irradiated with light having a prescribed wavelength from an outer surface side.

The phrase "reflection spectra is different when irradiated with light having a prescribed wavelength" means that the reflection spectra of the light having the prescribed wavelength incident from the outer surface of the multilayer body or the external terminal differs in at least one of lightness, chroma, and hue to the extent that the difference can be detected by visual inspection or using a device. It is only necessary that the difference can be identified when irradiated with light having a prescribed wavelength such as infrared light, visible light, or ultraviolet light.

The inductor wiring means the wiring causes a magnetic flux to be generated in the magnetic layer when a current flows through the inductor wiring.

In the inductor component according to the embodiment of the present disclosure, the overlapping region and the non-overlapping region can be distinguished from each other. Therefore, even after the formation of the external terminal, the connection position between the external terminal and the inductor wiring can be known.

In one embodiment of the inductor component, the light having the prescribed wavelength may be in the wavelength range of visible light.

In the above embodiment, the overlapping region and the non-overlapping region can be more easily distinguished from each other.

In one embodiment of the inductor component, the external terminal may have an overlapping portion that corresponds to the overlapping region and is disposed on the inductor wiring; and a non-overlapping portion that corresponds to the non-overlapping region and is disposed on the magnetic layer.

In the above embodiment, the overlapping portion and the non-overlapping portion in the external terminal can be distinguished from each other.

In one embodiment of the inductor component, the size of irregularities on an outer surface of the overlapping portion may differ from the size of irregularities on an outer surface of the non-overlapping portion.

In the above embodiment, the overlapping portion and the non-overlapping portion can be distinguished from each other using the lightness of the reflection spectra.

In one embodiment of the inductor component, the size of the irregularities on the outer surface of the non-overlapping portion may be larger than the size of the irregularities on the outer surface of the overlapping portion.

In the above embodiment, a portion exhibiting a reflection spectrum with a smaller lightness can be identified as the overlapping portion, and a portion exhibiting a reflection spectrum with a larger lightness can be identified as the non-overlapping portion.

In one embodiment of the inductor component, the multilayer body may further include a non-magnetic insulating coating disposed on an outer surface of the magnetic layer and may have an overlapping portion that corresponds to the overlapping region and is part of the insulating coating that is disposed on the inductor wiring; and a non-overlapping portion that corresponds to the non-overlapping region and is part of the insulating coating that is disposed on the magnetic layer.

In the above embodiment, since the insulating coating is provided, insulation between external terminals can be improved, and reliability can be improved. Moreover, the overlapping portion and the non-overlapping portion in the multilayer body (the insulating coating) can be distinguished from each other.

In one embodiment of the inductor component, the inductor wiring can be identified through the insulating coating.

In the above embodiment, the connection position between the external terminal and the inductor wiring can be easily known.

In one embodiment of the inductor component, the inductor wiring may include a spiral wiring member extending in a direction parallel to a principal surface of the magnetic layer; and a vertical wiring member that extends in a direction orthogonal to the principal surface of the magnetic layer and is connected to the spiral wiring member and to the external terminal.

The spiral wiring member has a curved shape extending in a flat plane (a two-dimensional curved shape). The number of turns of the curved shape may exceed 1 or may be less than one, and the curved shape may have a linear portion.

In the inductor wiring in the above embodiment, the extending direction of the spiral wiring member that provides inductance is perpendicular to the extending direction of the vertical wiring member that provides connection to the external terminal. Therefore, the formation region of the spiral wiring member and the formation region of the vertical wiring member do not interfere with each other, and the region in the multilayer body can be efficiently used.

In one embodiment of the inductor component, the vertical wiring member may include a columnar wiring member passing through the magnetic layer in a thickness direction thereof.

In the above embodiment, extra routing for connecting the external terminal to the spiral wiring member can be avoided.

In one embodiment of the inductor component, the external terminal may include a plurality of conductive layers.

In the above embodiment, when the conductive layers have their respective functions, the inductor component can be stably mounted. For example, Cu is used for the first conductive layer to planarize the magnetic layer, and Ni is formed as the second conductive layer and used as a barrier layer. Au is formed as the third layer to apply preservative treatment and to ensure solder wettability.

In one embodiment of the inductor component, one of the plurality of conductive layers that forms an outer surface may contain Au or Sn.

In the above embodiment, preservative treatment is applied to the external terminal, and good solder wettability can be obtained, so that the inductor component can be stably mounted.

In one embodiment of the inductor component, a first conductive layer among the plurality of conductive layers that is connected directly to the inductor wiring may be formed of Cu or an alloy containing Cu as a main component.

In the above embodiment, a high-electrical conductivity material is used for the first conductive layer, so that the direct current resistance of the external terminal can be reduced.

In one embodiment of the inductor component, the first conductive layer may contain Cu in an amount of about 95 wt % or more and Ni in an amount of from about 1 wt % to about 5 wt %.

In the above embodiment, since Ni is contained, stress in the first conductive layer is released, and a state close to a stress-free state is obtained. Therefore, stress on the inductor wiring can be relaxed, and the connectivity between the inductor wiring and the external terminal is improved. Since the amount of Ni is small, an increase in the direct current resistance of the first conductive layer can be prevented.

In one embodiment of the inductor component, a first conductive layer among the plurality of conductive layers that is connected directly to the inductor wiring may be formed of Ni or an alloy containing Ni as a main component.

In the above embodiment, erosion of the inductor wiring by solder can be prevented.

In one embodiment of the inductor component, an outer surface of the overlapping portion of the external terminal may have a recess located lower than an outer surface of the non-overlapping portion of the external terminal.

In the above embodiment, since the external terminal has the recess, the inductor component can be stably mounted due to a self-alignment effect in which a solder ball and a solder paste used for mounding flow into the recess.

In one embodiment of the inductor component, the external terminal may have a crack.

In the above embodiment, stress in the external terminal is released, and stress on the inductor wiring can be relaxed.

In one embodiment of the inductor component, when the thickness of the external terminal is set to 1, the depth of the recess may be about 0.05 or more and less than about 1.

In the above embodiment, the self-alignment effect by the recess can be obtained reliably, and excessive stress is not applied to the step in the recess.

In one embodiment of the inductor component, the magnetic layer may contain a resin and a magnetic metal powder embedded in the resin.

In the above embodiment, high magnetic saturation characteristics and the effect of reducing core loss at high frequencies can be obtained.

In one embodiment of the inductor component, the magnetic layer may further contain a ferrite powder.

In the above embodiment, since the high-relative permeability ferrite powder is contained, the effective permeability, which is the permeability per unit volume of the magnetic layer, can be improved.

In one embodiment of the inductor component, the inductor wiring may be formed of Cu, Ag, Au, Fe, or a compound thereof.

In the above embodiment, the electrical conductivity of the inductor wiring is high, so that the direct current resistance of the inductor component can be reduced.

Other features, elements, characteristics and advantages of the present disclosure will become more apparent from the following detailed description with reference to the attached drawings.

DETAILED DESCRIPTION

An inductor component, which is one aspect of the present disclosure, will be described in detail by way of illustrated embodiments. Some of the drawings are schematic, and actual dimensions and ratios may not be reflected therein.

First Embodiment (Structure)

Figure 1A:
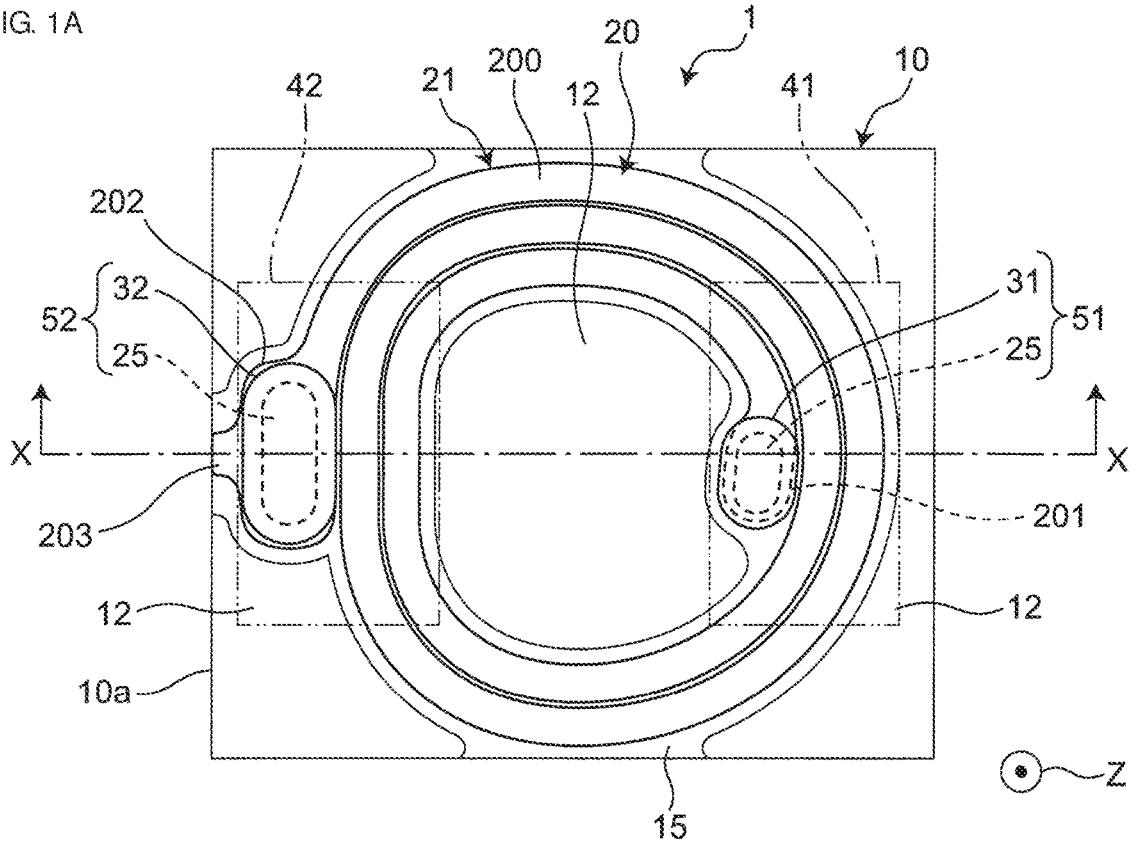
FIG. 1A is a transparent plan view showing an inductor component according to a first embodiment.
Figure 1B:
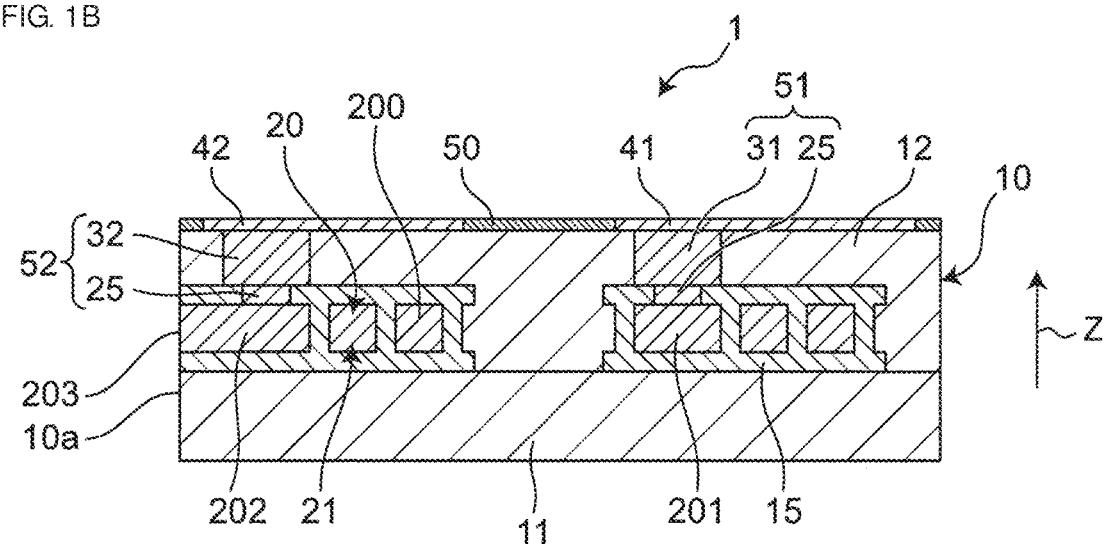
FIG. 1B is a cross-sectional view showing the inductor component according to the first embodiment.

FIG. 1A is a transparent plan view showing an inductor component according to a first embodiment. FIG. 1B is a cross-sectional view taken along X-X in FIG. 1A.

The inductor component 1 is installed in an electronic device such as a personal computer, a DVD player, a digital camera, a TV set, a cellular phone, a smartphone, or an automobile electronic device and has, for example, a substantially rectangular parallelepipedic overall shape. However, no particular limitation is imposed on the shape of the inductor component 1, and the inductor component 1 may have a substantially cylindrical shape, a substantially polygonal prismatic shape, a substantially truncated conical shape, or a substantially truncated polygonal pyramid shape.

As shown in FIGS. 1A and 1B, the inductor component 1 includes a multilayer body 10, an inductor wiring 20, and first and second external terminals 41 and 42. The multilayer body 10 includes a first magnetic layer 11, a second magnetic layer 12, an insulating layer 15, and an insulating coating 50. The inductor wiring 20 is disposed inside the multilayer body 10 and includes a spiral wiring member 21 and first and second vertical wiring members 51 and 52 (examples of extended wiring members). The external terminals 41 and 42 are exposed from the multilayer body 10.

The first magnetic layer 11 and the second magnetic layer 12 are stacked in a first direction Z and each have a principal surface orthogonal to the first direction Z. The multilayer body 10 includes the two magnetic layers, i.e., the first magnetic layer 11 and the second magnetic layer 12, but may include three or more magnetic layers or only one magnetic layer. In the drawings, the positive side in the first direction Z is referred to as an upper side, and the negative side is referred to as a lower side.

Each of the first magnetic layer 11 and the second magnetic layer 12 contains a resin and a magnetic metal powder embedded in the resin. The magnetic metal powder provides high magnetic saturation characteristics, and the resin provides insulation between particles of the magnetic metal powder, so that core loss at high frequencies can be reduced.

The resin includes, for example, an epoxy resin, a polyimide resin, a phenol resin, or a vinyl ether resin. In this case, improved insulation reliability can be obtained. More specifically, the resin is an epoxy resin, a mixture of an epoxy resin and an acrylic resin, or a mixture of an epoxy resin, an acrylic resin, and an additional resin. In this case, insulation between particles of the magnetic metal powder is ensured, so that core loss at high frequencies can be reduced.

The average particle diameter of the magnetic metal powder is, for example, from about 0.1 μm to about 5 μm. In a production stage of the inductor component 1, the average particle diameter of the magnetic metal powder can be computed as a particle diameter corresponding to a value at a cumulative frequency of 50% in a particle size distribution determined by a laser diffraction-scattering method. The magnetic metal powder is powder of an FeSi-based alloy such as FeSiCr, an FeCo-based alloy, an Fe-based alloy such at NiFe, or an amorphous alloy thereof. The content of the magnetic metal powder is preferably from about 20 vol % to about 70 vol % based on the total volume of the magnetic layer. When the average particle diameter of the magnetic metal powder is about 5 μm or less, higher magnetic saturation characteristics can be obtained, and the fine powder can reduce the core loss at high frequencies. Instead of the magnetic metal powder, a magnetic ferrite powder such as a NiZn-based or MnZn-based powder may be used. When the ferrite with high relative permeability is contained, the effective permeability, which is the permeability per unit volume of the magnetic layers 11 and 12, can be improved.

The spiral wiring member 21 is formed only on the upper side of the first magnetic layer 11, i.e., only on the insulating layer 15 on the top surface of the first magnetic layer 11, and extends in directions parallel to the principal surface of the first magnetic layer 11. In the present embodiment, the number of turns of the spiral wiring member 21 exceeds 1 and is about 2.5. The spiral wiring member 21 is spirally wound clockwise from its outer end toward its inner end when viewed from above.

Preferably, the thickness of the spiral wiring member 21 is, for example, from about 40 μm to about 120 μm. In one example, the spiral wiring member 21 has a thickness of about 45 μm, a wiring width of about 50 μm, and a wiring spacing of about 10 μm. The wiring spacing is preferably from about 3 μm to about 20. The thickness of the spiral wiring member 21 is its maximum dimension in the first direction Z in a cross section orthogonal to the extending direction of the spiral wiring member 21.

The spiral wiring member 21 is formed of a conductive material, i.e., a low-electrical resistance metal material such as Cu, Ag, Au, Fe, or a compound thereof. In this case, the electrical conductivity can be increased, and the direct current resistance can be reduced. In the present embodiment, the inductor component 1 includes only one spiral wiring member 21 and can be reduced in height. The inductor component 1 may include a plurality of spiral wiring members 21, and the plurality of spiral wiring members 21 may be electrically connected in series through via conductors.

The spiral wiring member 21 includes a spiral portion 200, first and second pad portions 201 and 202, and an extended portion 203 that are connected to each other and disposed in a plane orthogonal to the first direction Z (disposed in directions parallel to the principal surface of the first magnetic layer 11). The first pad portion 201 is disposed at the inner end of the spiral portion 200, and the second pad portion 202 is disposed at the outer end of the spiral portion 200. The spiral portion 200 is wound spirally in a region between the first pad portion 201 and the second pad portion 202. The first pad portion 201 is connected to the first vertical wiring member 51, and the second pad portion 202 is connected to the second vertical wiring member 52. The extended portion 203 extends from the second pad portion 202 to a first side surface 10*a* of the multilayer body 10 parallel to the first direction Z and is exposed to the outside at the first side surface 10*a* of the multilayer body 10.

The insulating layer 15 is a film-like layer formed on the top surface of the first magnetic layer 11 and covers the spiral wiring member 21. Since the spiral wiring member 21 is covered with the insulating layer 15, insulation reliability can be improved. Specifically, the insulating layer 15 covers the entire bottom and side surfaces of the spiral wiring member 21 and covers the top surface of the spiral wiring member 21 except for connecting portions between via conductors 25 and the pad portions 201 and 202. The insulating layer 15 has holes at positions corresponding to the pad portions 201 and 202 of the spiral wiring member 21. The holes can be formed by photolithography or laser drilling. The thickness of the insulating layer 15 between the first magnetic layer 11 and the bottom surface of the spiral wiring member 21 is, for example, about 10 μm or less.

The insulating layer 15 is formed of an insulating material containing no magnetic material, e.g., a resin material such as an epoxy resin, a phenol resin, or a polyimide resin. The insulating layer 15 may contain a non-magnetic filler such as silica. In this case, the strength, workability, and electric characteristics of the insulating layer 15 can be improved. The insulating layer 15 is not an essential component, and the spiral wiring member 21 may be in direct contact with the first magnetic layer 11 and the second magnetic layer 12. The insulating layer 15 may cover only part of the bottom, side, and top surfaces of the spiral wiring member 21.

The vertical wiring members 51 and 52 are formed of a conductive material, extend in the first direction Z from the respective pad portions 201 and 202 of the spiral wiring member 21, and are connected to the spiral wiring member 21 and the respective external terminals 41 and 42. Since the vertical wiring members 51 and 52 pass through the second magnetic layer 12, extra routing of wiring for connecting the external terminals 41 and 42 to the spiral wiring member 21 can be avoided. The vertical wiring members 51 and 52 include the via conductors 25 extending in the first direction Z from the respective pad portions 201 and 202 of the spiral wiring member 21 and passing through the insulating layer 15; and first and second columnar wiring members 31 and 32 extending in the first direction Z from the respective via conductors 25 and passing through the second magnetic layer 12. The columnar wiring members 31 and 32 are exposed at the top surface of the second magnetic layer 12.

The first vertical wiring member 51 includes the via conductor 25 extending upward from the top surface of the first pad portion 201 of the spiral wiring member 21; and the first columnar wiring member 31 extending upward from the via conductor 25 and passing through the second magnetic layer 12. The second vertical wiring member 52 includes the via conductor 25 extending upward from the second pad portion 202 of the spiral wiring member 21; and the second columnar wiring member 32 extending upward from the via conductor 25 and passing through the second magnetic layer 12. The vertical wiring members 51 and 52 are formed of the same material as the material of the spiral wiring member 21.

The external terminals 41 and 42 are formed of a conductive material. The first external terminal 41 is disposed so as to cover the first columnar wiring member 31 and to extend on the second magnetic layer 12 and is exposed at the top surface of the multilayer body 10. The first external terminal 41 is thereby electrically connected to the first pad portion 201 of the spiral wiring member 21. The second external terminal 42 is disposed so as to cover the second columnar wiring member 32 and to extend on the second magnetic layer 12 and is exposed at the top surface of the multilayer body 10. The second external terminal 42 is thereby electrically connected to the second pad portion 202 of the spiral wiring member 21.

Preferably, the external terminals 41 and 42 are each composed of a plurality of conductive layers. When the conductive layers have their respective functions, the inductor component 1 can be stably mounted. For example, Cu is used for the first conductive layer to planarize the second magnetic layer 12, and Ni is formed as the second conductive layer and used as a barrier layer. Au is formed as the third layer to thereby apply preservative treatment and obtain solder wettability.

Preferably, the conductive layer forming the outer surface of each of the external terminals 41 and 42 contains Au or Sn, and may be formed of Au, Sn, or an alloy containing Au or Sn. In this case, preservative treatment is applied to the external terminals 41 and 42, and good solder wettability can be obtained, so that the inductor component 1 can be stably mounted.

Preferably, the first conductive layer of each of the external terminals 41 and 42 that is connected directly to the inductor wiring 20 is formed of Cu or an alloy containing Cu as a main component. In this case, since the high-electrical conductivity material is used for the first conductive layer, the direct current resistance of the external terminals 41 and 42 can be reduced.

Preferably, the first conductive layer contains Cu in an amount of about 95 wt % or more and Ni in an amount of from about 1 wt % to about 5 wt %. When Ni is contained, stress in the first conductive layer is released, and a state close to a stress-free state is obtained. Therefore, stress on the inductor wiring 20 can be relaxed, and the connectivity between the inductor wiring 20 and the external terminals 41 and 42 is improved. Since the amount of Ni is small, an increase in the direct current resistance of the first conductive layer can be prevented.

Preferably, the first conductive layer in each of the external terminals 41 and 42 is formed of Ni or an alloy containing Ni as a main component. In this case, Ni is formed on the vertical wiring members 51 and 52 and serves as a barrier, so that the vertical wiring members 51 and 52 are prevented from erosion by solder. Specifically, the Ni alloy layer is, for example, a layer of a NiP alloy containing about 2 wt % to about 10 wt % of P. In this case, a catalyst layer such as a Pd layer is present between the Ni layer and its underlying materials (the magnetic layer and the columnar wiring members). The catalyst layer is not a layer included in the external terminals 41 and 42.

The insulating coating 50 is formed of a non-magnetic insulating material and disposed on the top surface, i.e., the outer surface, of the second magnetic layer 12. Part of the second magnetic layer 12, end surfaces of the columnar wiring members 31 and 32, and end surfaces of the external terminals 41 and 42 are not covered by the insulating coating 50 and are exposed from the insulating coating 50. The insulating coating 50 can provide insulating properties on the surface of the inductor component 1. By providing the insulating coating 50, the insulation between the first external terminal 41 and the second external terminal 42 can be enhanced, and reliability can be improved. The insulating coating 50 may be formed on the lower side of the first magnetic layer 11.

Figure 2:
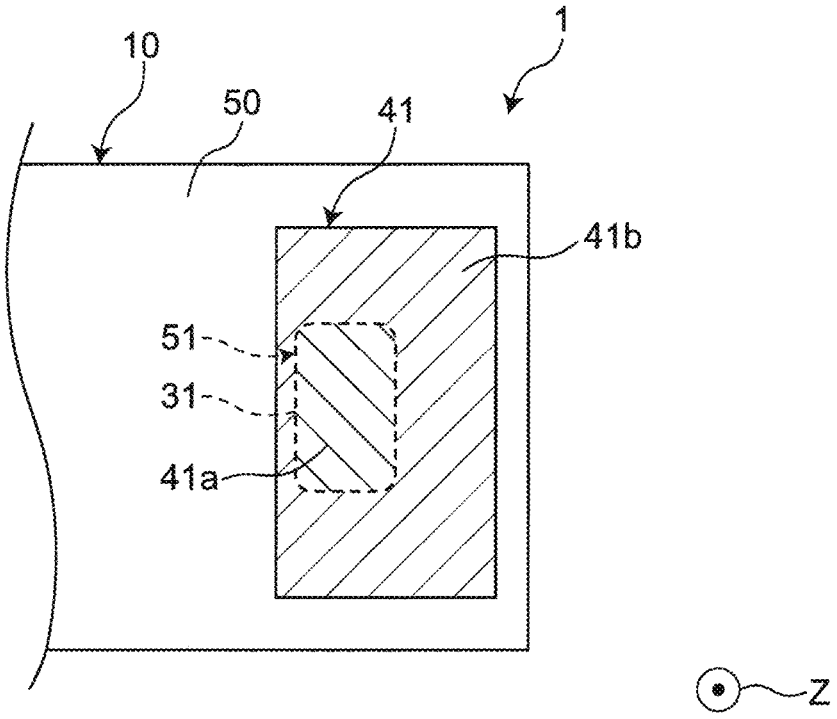
FIG. 2 is a simplified plan view showing one positional relation between a first external terminal and a first vertical wiring member.

FIG. 2 is a simplified plan view showing the positional relation between the first external terminal 41 and the first vertical wiring member 51 when they are viewed in the first direction Z. As shown in FIG. 2, the first external terminal 41 has an overlapping region which is disposed on the first vertical wiring member 51 (the inductor wiring 20) and a non-overlapping region which is not in contact with the first vertical wiring member 51 (the inductor wiring 20), and reflection spectra of the overlapping region is different from reflection spectra of the non-overlapping region when irradiated with light with a prescribed wavelength from the outer surface side.

Specifically, the first external terminal 41 has an overlapping portion 41*a* in contact with the first vertical wiring member 51 (the first columnar wiring member 31) and a non-overlapping portion 41*b* in contact with the second magnetic layer 12. The overlapping portion 41*a* corresponds to the overlapping region, and the non-overlapping portion 41*b* corresponds to the non-overlapping region. The overlapping portion 41*a* and the non-overlapping portion 41*b* are hatched differently. The size of the first vertical wiring member 51 is smaller than the size of the first external terminal 41, and the entire first vertical wiring member 51 overlaps part of the first external terminal 41.

The reflection spectrum of the overlapping portion 41*a* differs from that of the non-overlapping portion 41*b*. Therefore, when viewed from the outer surface side of the first external terminal 41 (e.g., when viewed in the first direction Z), the overlapping portion 41*a* and the non-overlapping portion 41*b* differ in at least one of lightness, chroma, and hue. This allows the overlapping portion 41*a* and the non-overlapping portion 41*b* to be distinguished from each other by visual inspection or using a device. It is only necessary that they can be distinguished from each other when irradiated with light with a prescribed wavelength such as infrared light, visible light, or ultraviolet light. When the light with the prescribed wavelength is in the wavelength range of visible light, the overlapping portion 41*a* and the non-overlapping portion 41*b* can be distinguished from each other more easily.

The size of irregularities on the outer surface of the overlapping portion 41*a* differs from the size of irregularities on the outer surface of the non-overlapping portion 41*b*. The size of the irregularities on the outer surface of the non-overlapping portion 41*b* is larger than the size of the irregularities on the outer surface of the overlapping portion 41*a*. For example, the surface roughness Ra of the non-overlapping portion 41*b* is larger than the surface roughness Ra of the overlapping portion 41*a*. For example, the surface roughness Ra of the non-overlapping portion 41*b* is larger than the surface roughness Ra of the overlapping portion 41*a* by a factor of from about 1.5 to about 2.5.

The reason that the surface roughness Ra of the overlapping portion 41*a* differs from the surface roughness Ra of the non-overlapping portion 41*b* as described above is that the overlapping portion 41*a* is formed on the top surface of the first vertical wiring member 51 (the first columnar wiring member 31) and the non-overlapping portion 41*b* is formed on the top surface of the multilayer body 10 (the magnetic layer 12). Specifically, since the first vertical wiring member 51 is formed of a metal, the top surface of the first vertical wiring member 51 is smooth. However, since the magnetic layer 12 is formed of a composite material containing a resin and a magnetic metal powder, the top surface of the second magnetic layer 12 is rough. Since the overlapping portion 41*a* is formed on the top surface of the first vertical wiring member 51, the shape of the top surface of the first vertical wiring member 51 is transferred onto the overlapping portion 41*a*. Since the non-overlapping portion 41*b* is formed on the top surface of the magnetic layer 12, the shape of the top surface of the second magnetic layer 12 is transferred onto the non-overlapping portion 41*b*. This is the reason that the surface of the non-overlapping portion 41*b* is rougher than the surface of the overlapping portion 41*a*.

Since the size of the irregularities on the outer surface of the overlapping portion 41*a* differs from the size of the irregularities on the outer surface of the non-overlapping portion 41*b*, the overlapping portion 41*a* and the non-overlapping portion 41*b* can be distinguished from each other using the lightness of reflection spectra. Specifically, since the size of the irregularities on the outer surface of the non-overlapping portion 41*b* is larger than the size of the irregularities on the outer surface of the overlapping portion 41*a*, a portion exhibiting a reflection spectrum with a smaller lightness can be identified as the overlapping portion 41*a*, and a portion exhibiting a reflection spectrum with a larger lightness can be identified as the non-overlapping portion 41*b*.

In the inductor component 1, since the reflection spectra of the overlapping region (the overlapping portion 41*a*) is different from the reflection spectra of the non-overlapping region (the non-overlapping portion 41*b*) in the first external terminal 41 when irradiated with light with a prescribed wavelength from the outer surface side, the overlapping region (the overlapping portion 41*a*) and the non-overlapping region (the non-overlapping portion 41*b*) can be distinguished from each other. Therefore, even after the formation of the first external terminal 41, the connection position between the first external terminal 41 and the inductor wiring 20 (the first vertical wiring member 51) can be known.

Specifically, suppose that the overlapping portion 41*a* and the non-overlapping portion 41*b* can be distinguished from each other using, for example, lightness. As for the positional relation between the first external terminal 41 and the first columnar wiring member 31 shown in FIG. 2, it can be judged that the first external terminal 41 is larger than the first columnar wiring member 31 and the entire first columnar wiring member 31 overlaps the first external terminal 41. In this case, the connectivity between the first external terminal 41 and the first vertical wiring member 51 is good. As for the positional relation between the first external terminal 41 and the first columnar wiring member 31 shown in FIG. 3, it can be judged that the first external terminal 41 is larger than the first columnar wiring member 31 and only part of the first columnar wiring member 31 overlaps the first external terminal 41. In this case, the connectivity between the first external terminal 41 and the first vertical wiring member 51 decreases as the size of the non-overlapping area increases.

Even after the formation of the first external terminal 41, the connection position between the first external terminal 41 and the first vertical wiring member 51 (the inductor wiring 20) can be known, so that it can be determined whether the connection between the first external terminal 41 and the inductor wiring 20 is impaired.

The same applies to the positional relation between the second external terminal 42 and the second vertical wiring member 52. Specifically, the second external terminal 42 has an overlapping region which is disposed on the inductor wiring 20 (the second vertical wiring member 52) and a non-overlapping region which is not in contact with the inductor wiring 20 (the second vertical wiring member 52), and the reflection spectra of the overlapping region is different from the reflection spectra of the non-overlapping region when irradiated with light with a prescribed wavelength from the outer surface side. The second external terminal 42 has an overlapping portion corresponding to the overlapping region and disposed on the inductor wiring 20 and a non-overlapping portion corresponding to the non-overlapping region and disposed on the second magnetic layer 12.

Second Embodiment

Figure 4:
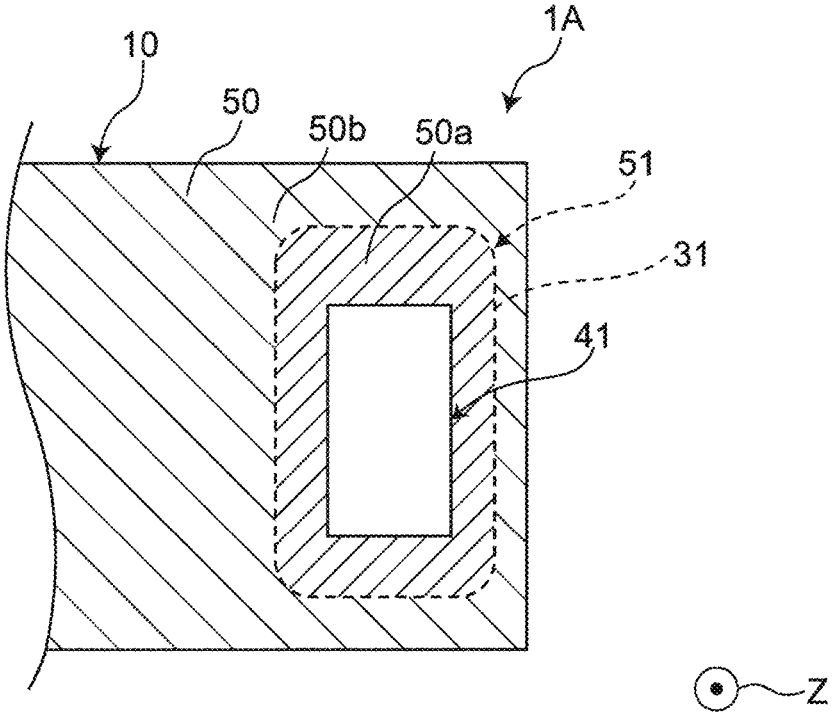
FIG. 4 is a simplified plan view showing one positional relation between a first external terminal and a first vertical wiring member in an inductor component according to a second embodiment.

FIG. 4 is a simplified plan view showing an inductor component according to a second embodiment. In the second embodiment, the sizes of the external terminals and the vertical wiring members differ from those in the first embodiment. These differences will next be described. The other components of the second embodiment are the same as those of the first embodiment, and their description will be omitted.

As shown in FIG. 4, in the inductor component 1A in the second embodiment, the first external terminal 41 is smaller than the first vertical wiring member 51 (the first columnar wiring member 31), and the entire first external terminal 41 overlaps part of the first vertical wiring member 51, when they are viewed in the first direction Z.

The multilayer body 10 has an overlapping portion 50*a* that corresponds to the overlapping region and is part of the insulating coating 50 that is disposed on the inductor wiring 20 (the first vertical wiring member 51); and a non-overlapping portion 50*b* that corresponds to the non-overlapping region and is part of the insulating coating 50 that is disposed on the second magnetic layer 12 (see FIG. 1B). The overlapping portion 50*a* and the non-overlapping portion 50*b* are hatched differently. The reflection spectra of the overlapping portion 50*a* is different from the reflection spectra of the non-overlapping portion when irradiated with light with a prescribed wavelength from the outer surface side. Therefore, the overlapping portion 50*a* and the non-overlapping portion 50*b* in the multilayer body 10 (the insulating coating 50) can be distinguished from each other. Even after the formation of the first external terminal 41, the connection position between the first external terminal 41 and the inductor wiring 20 (the first vertical wiring member 51) can be known.

Figure 5:
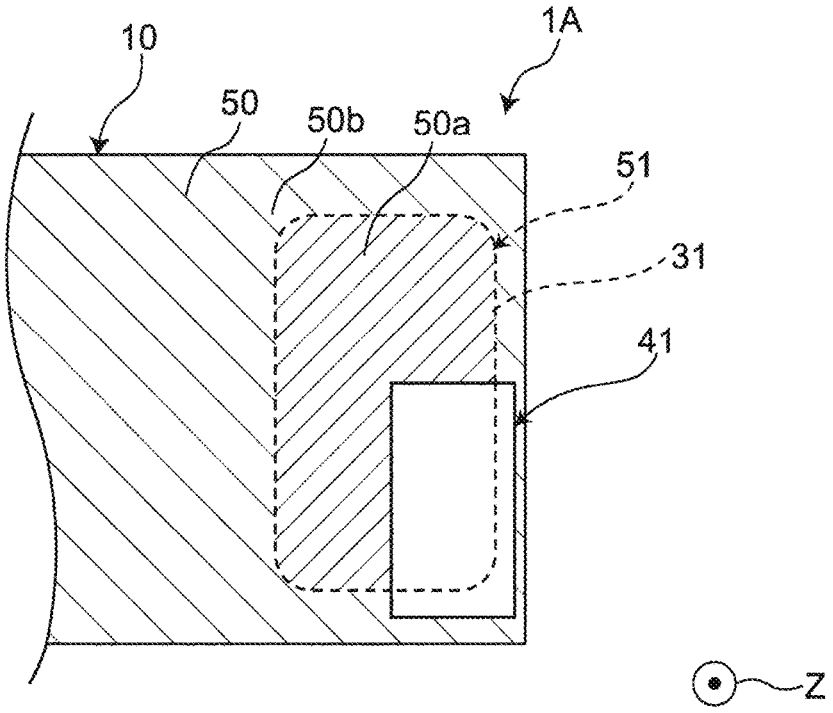
FIG. 5 is a simplified plan view showing another positional relation between the first external terminal and the first vertical wiring member.

Specifically, suppose that the overlapping portion 50*a* and the non-overlapping portion 50*b* can be distinguished from each other using, for example, chroma or hue (chromaticity). As for the positional relation between the first external terminal 41 and the first columnar wiring member 31 shown in FIG. 4, it can be judged that the first columnar wiring member 31 is larger than the first external terminal 41 and the entire first external terminal 41 overlaps the first columnar wiring member 31. In this case, the connectivity between the first external terminal 41 and the first vertical wiring member 51 is good. As for the positional relation between the first external terminal 41 and the first columnar wiring member 31 shown in FIG. 5, it can be judged that the first columnar wiring member 31 is larger than the first external terminal 41 and only part of the first external terminal 41 overlaps the first columnar wiring member 31. In this case, the connectivity between the first external terminal 41 and the first vertical wiring member 51 decreases as the size of the non-overlapping area increases.

Preferably, the inductor wiring 20 (the first vertical wiring member 51) can be identified through the insulating coating 50. In this case, the connection position between the first external terminal 41 and the inductor wiring 20 can be more easily known.

The same applies to the positional relation between the second external terminal 42 and the second vertical wiring member 52. Specifically, the multilayer body 10 has an overlapping portion 50*a* that corresponds to the overlapping region and is part of the insulating coating 50 that is disposed on the inductor wiring 20 (the second vertical wiring member 52); and a non-overlapping portion 50*b* that corresponds to the non-overlapping region and is part of the insulating coating 50 that is disposed on the second magnetic layer 12. The reflection spectra of overlapping portion 50*a* is different from the reflection spectra of the non-overlapping portion 50*b* when irradiated with light with a prescribed wavelength from the outer surface side.

Third Embodiment

Figure 6:
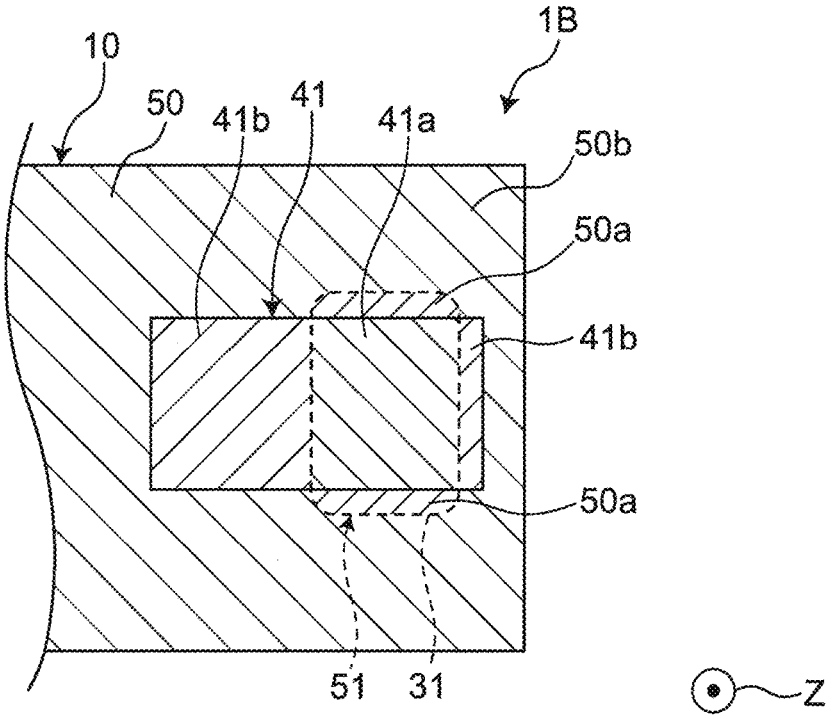
FIG. 6 is a simplified plan view showing the positional relation between a first external terminal and a first vertical wiring member in an inductor component according to a third embodiment.

FIG. 6 is a simplified plan view showing an inductor component according to a third embodiment. The sizes of the external terminals and the vertical wiring members in the third embodiment differ from those in the first embodiment. These differences will next be described. The other components of the third embodiment are the same as those of the first embodiment, and their description will be omitted.

As shown in FIG. 6, in the inductor component 1B in the third embodiment, part of the first external terminal 41 overlaps part of the first vertical wiring member 51 (the first columnar wiring member 31) when they are viewed in the first direction Z. The first external terminal 41 has an overlapping portion 41*a* on the inductor wiring 20 (the first vertical wiring member 51) and a non-overlapping portion 41*b* on the second magnetic layer 12. The multilayer body 10 has an overlapping portion 50*a* that is part of the insulating coating 50 that is disposed on the inductor wiring 20 (the first vertical wiring member 51); and a non-overlapping portion 50*b* that is part of the insulating coating 50 that is disposed on the second magnetic layer 12. The overlapping portions 41*a* and 50*a* and the non-overlapping portions 41*b* and 50*b* are hatched differently. Each of the overlapping portions 41*a* and 50*a* corresponds to the overlapping region. Each of the non-overlapping portions 41*b* and 50*b* corresponds to the non-overlapping region.

The overlapping portion 41*a* and the non-overlapping portion 41*b* in the first external terminal 41 have the same structure as that in the first embodiment and exhibit different reflection spectra each other. The overlapping portion 50*a* and the non-overlapping portion 50*b* in the multilayer body 10 (the insulating coating 50) have the same structure as that in the second embodiment and exhibit different reflection spectra each other.

Therefore, the overlapping portion 41*a* and the non-overlapping portion 41*b* in the first external terminal 41 can be distinguished from each other, and the overlapping portion 50*a* and the non-overlapping portion 50*b* in the multilayer body 10 can be distinguished from each other. The connection position between the first external terminal 41 and the inductor wiring 20 (the first vertical wiring member 51) can thereby be known even after the formation of the first external terminal 41.

The same applies to the positional relation between the second external terminal 42 and the second vertical wiring member 52. Specifically, the second external terminal 42 has an overlapping portion on the inductor wiring 20 (the second vertical wiring member 52) and a non-overlapping portion on the second magnetic layer 12. The multilayer body 10 has an overlapping portion that is part of the insulating coating 50 that is disposed on the inductor wiring 20 (the second vertical wiring member 52); and the non-overlapping portion 50*b* that is part of the insulating coating 50 that is disposed on the second magnetic layer 12. The overlapping portion and the non-overlapping portion in the second external terminal 42 exhibit different reflection spectra each other. The overlapping portion and the non-overlapping portion 50*b* in the multilayer body 10 exhibit different reflection spectra each other. Each of the overlapping portion of the second external terminal 42 and the overlapping portion of the multilayer body corresponds to the overlapping region, and each of the non-overlapping portion of the second external terminal 42 and the non-overlapping portion 50*b* of the multilayer body corresponds to the non-overlapping region.

Fourth Embodiment

Figure 7:
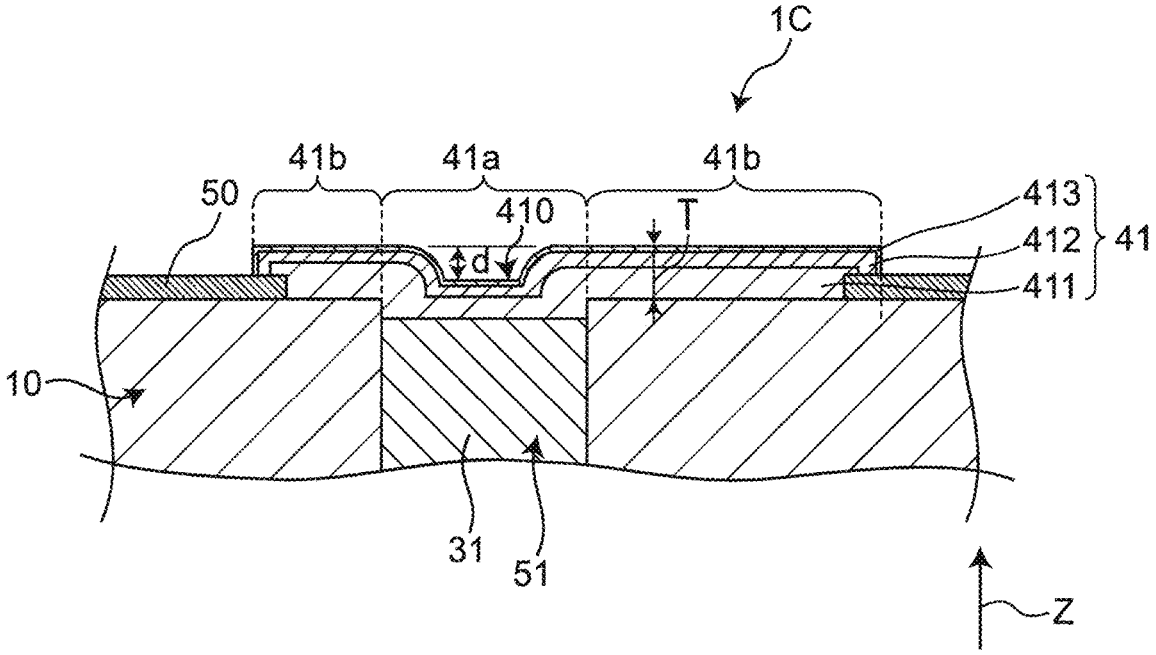
FIG. 7 is a simplified cross-sectional view showing an inductor component according to a fourth embodiment.

FIG. 7 is a simplified cross-sectional view showing an inductor component according to a fourth embodiment. The shape of the external terminals in the fourth embodiment differs from that in the first embodiment. This difference will next be described. The other components in the fourth embodiment are the same as those in the first embodiment, and their description will be omitted.

As shown in FIG. 7, in the inductor component 1C in the fourth embodiment, the outer surface of the overlapping portion 41*a* of the first external terminal 41 has a recess 410 located lower than the outer surface of the non-overlapping portion 41*b* of the first external terminal 41. The bottom surface of the recess 410 is located lower than the outer surface (the top surface) of the non-overlapping portion 41*b*.

An example of a method for forming the recess 410 will be described. After the first columnar wiring member 31 is formed in the multilayer body 10 (the magnetic layer 12), the multilayer body 10 is subjected to soft etching. The first columnar wiring member 31 is thereby etched, and the top surface of the first columnar wiring member 31 becomes lower than the top surface of the multilayer body 10. Then the first external terminal 41 is formed on the first columnar wiring member 31 and the multilayer body 10 by electroless plating. In the first external terminal 41, a portion on the first columnar wiring member 31 is formed at a position lower than a portion on the multilayer body 10. In this manner, the recess 410 is formed in the overlapping portion 41*a* on the first columnar wiring member 31 of the first external terminal 41.

Since the first external terminal 41 has the recess 410, the inductor component 1C can be stably mounted due to the self-alignment effect in which a solder ball and a solder paste used for mounding flow into the recess 410.

Preferably, the first external terminal 41 has a crack. In this case, stress in the first external terminal 41 is released, and stress on the inductor wiring 20 can be relaxed.

Preferably, when the thickness T of the first external terminal 41 is set to 1, the depth d of the recess 410 is about 0.05 or more and less than about 1 (i.e., from about 0.05 to about 1). In this case, the self-alignment effect by the recess 410 is obtained reliably, and excessive stress is not applied to the step in the recess 410.

The thickness T of the first external terminal 41 is the thickness of a portion (the non-overlapping portion 41*b*) of the first external terminal 41 that is in contact with the multilayer body 10 (the magnetic layer 12) and is, for example, the thickness of a central portion, with respect to the width direction, in a cross section of the non-overlapping portion 41*b* of the first external terminal 41. When the first external terminal 41 includes a first conductive layer 411 formed as an electroless Cu plating layer, a second conductive layer 412 formed as a Cu electroplating layer, and a third conductive layer 413 formed as an electroless Au plating layer and the first columnar wiring member 31 is formed as an electroless Cu plating layer, the boundary between the first conductive layer 411 and the first columnar wiring member 31 is not easily identified. Therefore, it is difficult to measure the thickness of a portion (the overlapping portion 41*a*) of the first external terminal 41 that is in contact with the first columnar wiring member 31. In this case, by measuring the thickness of a portion (the non-overlapping portion 41*b*) of the first external terminal 41 that is in contact with the multilayer body 10, the thickness of the first external terminal 41 can be easily determined.

The above also applies to the shape of the second external terminal 42. Specifically, the outer surface of an overlapping portion 42*a* of the second external terminal 42 has a recess 410, and the inductor component 1C can be stably mounted.

The present disclosure is not limited to the above-described embodiments and may be changed in design without departing from the spirit of the disclosure. For example, the features of the first to fourth embodiments may be combined variously.

In each of the above embodiments, both the first external terminal and the second external terminal have the feature of the embodiment. However, at least one of the first external terminal and the second external terminal may have the feature.

In the above embodiments, the vertical wiring members include the respective via conductors and the respective columnar wiring members. However, when no insulating layer is provided, the vertical wiring members may include only the respective columnar wiring members. In the above embodiments, the extended wiring members extend in the first direction. However, the extended wiring members may extend in a direction orthogonal to the first direction and may be exposed at a side surface of a magnetic layer.

First Example

Figure 8A:
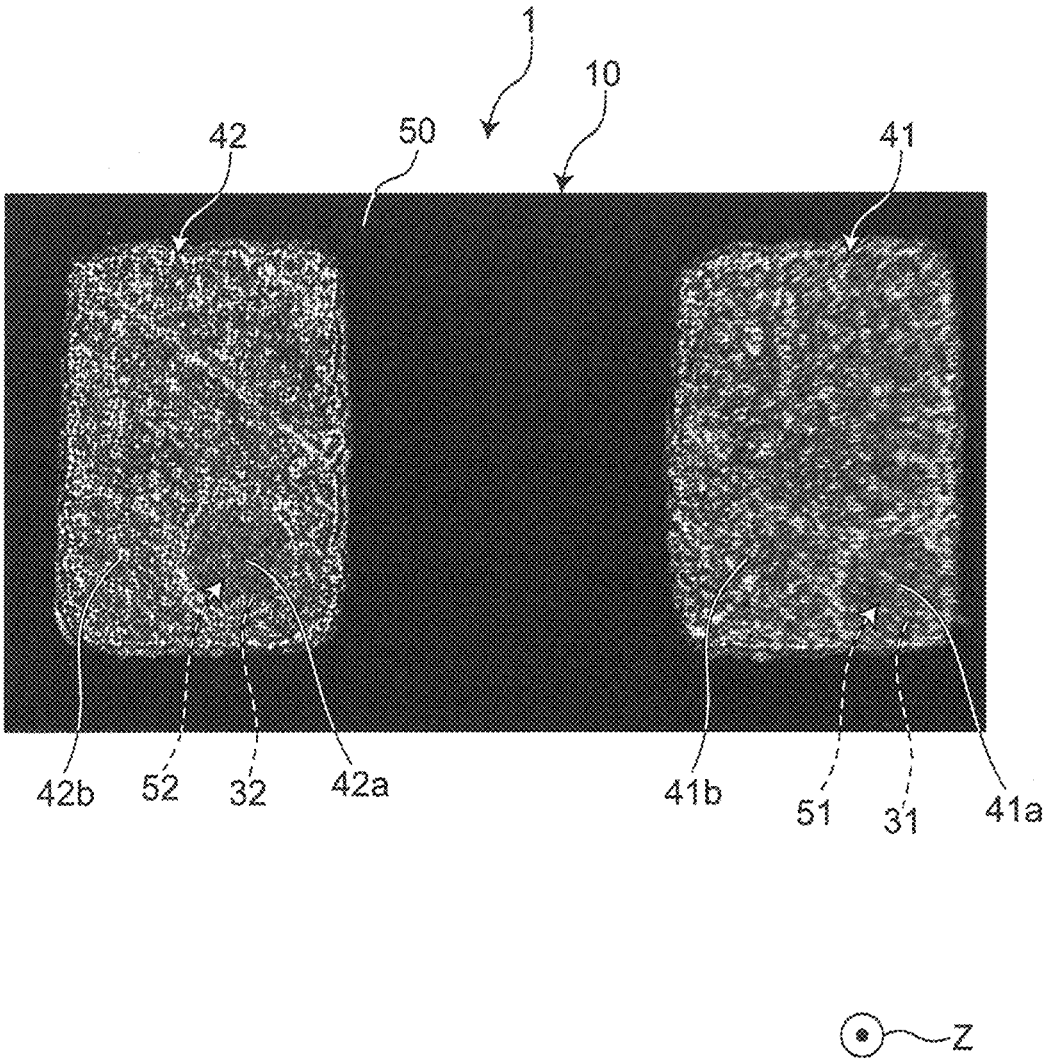
FIG. 8A is an image showing an Example of the first embodiment.

FIG. 8A shows an Example of the first embodiment (FIG. 2). As shown in FIG. 8A, the first columnar wiring member 31 has a substantially cylindrical shape, and the reflection spectra of the overlapping portion 41*a* is different from the reflection spectra of the non-overlapping portion 41*b* in the first external terminal 41. Specifically, the size of the irregularities in the non-overlapping portion 41*b* is larger than the size of the irregularities in the overlapping portion 41*a*. Therefore, the overlapping portion 41*a* and the non-overlapping portion 41*b* differ in lightness and hue, and the overlapping portion 41*a* is darker than the non-overlapping portion 41*b*, so that the overlapping portion 41*a* and the non-overlapping portion 41*b* can be visually distinguished from each other. When they can be visually distinguished from each other as described above, they can be easily identified. Similarly, in the second external terminal 42, the overlapping portion 42*a* and the non-overlapping portion 42*b* exhibit different reflection spectra each other.

Figure 3:
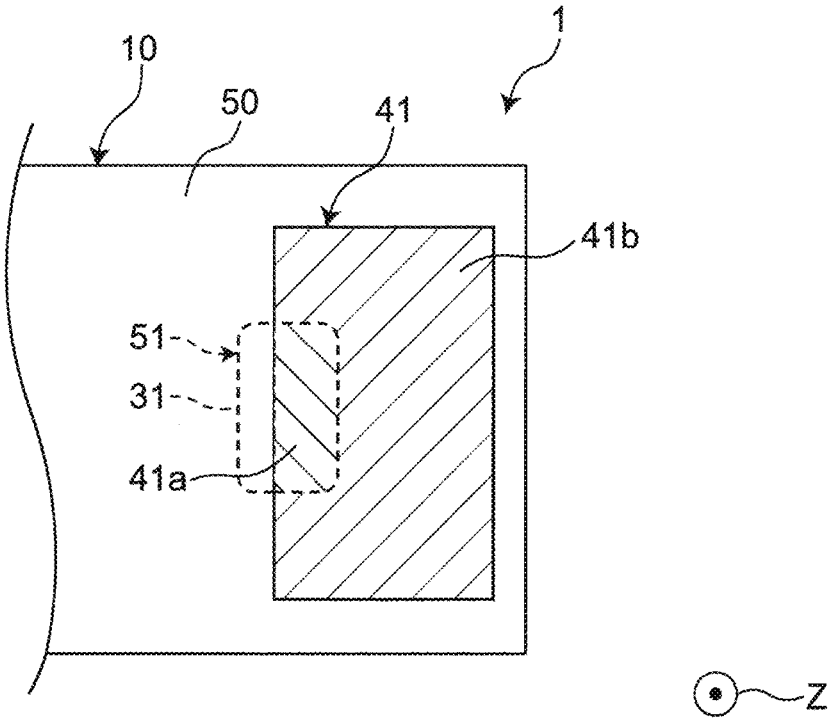
FIG. 3 is a simplified plan view showing another positional relation between the first external terminal and the first vertical wiring member.
Figure 8B:
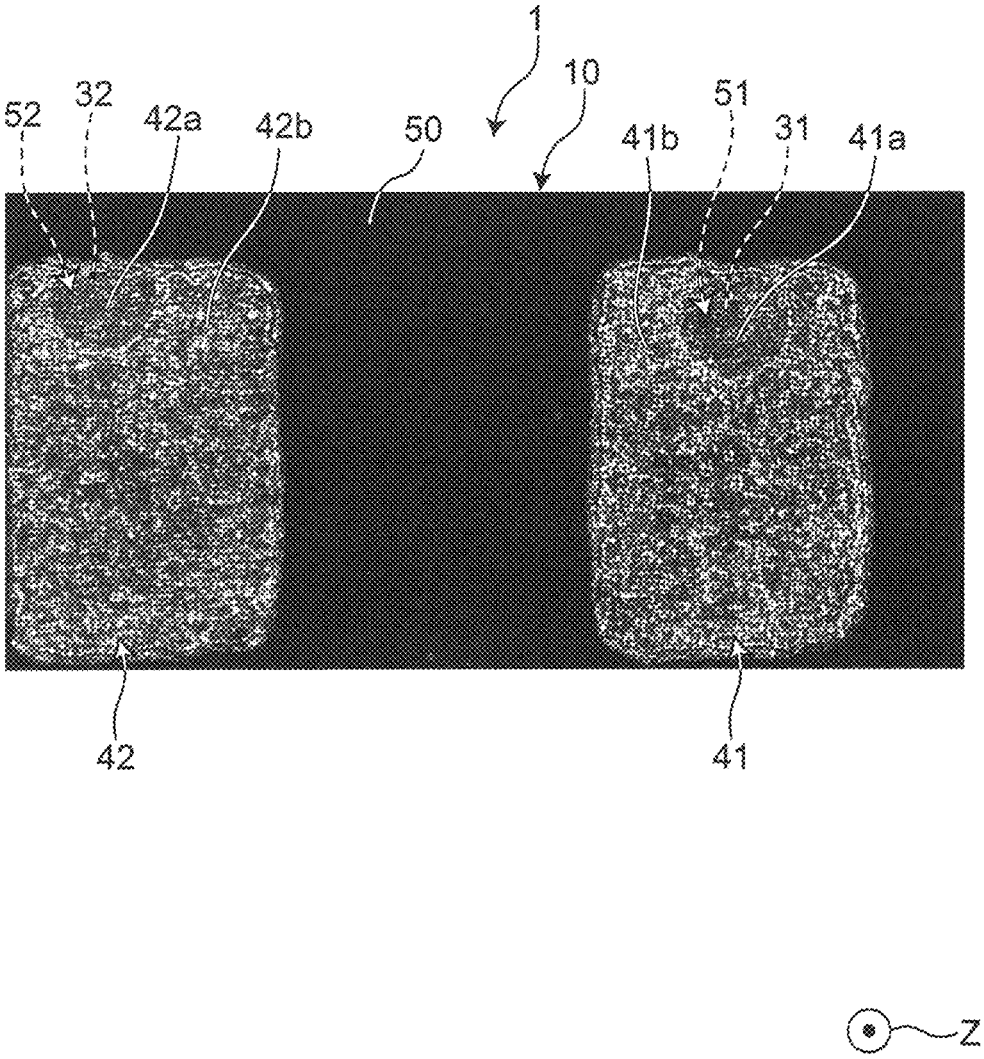
FIG. 8B is an image showing another Example of the first embodiment.

FIG. 8B shows another Example of the first embodiment (FIG. 3). As shown in FIG. 8B, part of the second columnar wiring member 32 is located directly below the second external terminal 42, and the other part of the second columnar wiring member 32 is located directly below the insulating coating 50. In this case, the overlapping portion 42*a* and the non-overlapping portion 42*b* in the second external terminal 42 exhibit different reflection spectra each other, and the overlapping portion 41*a* and the non-overlapping portion 41*b* can be distinguished from each other. The part of the second columnar wiring member 32 located immediately below the insulating coating 50 cannot be visually seen. In this case, the second columnar wiring member 32 can be identified only at a position directly below the second external terminal 42.

The positional relation between the first external terminal 41 and the first columnar wiring member 31 is the same as that in FIG. 8A, and the description thereof will be omitted.

Second Example

Figure 9:
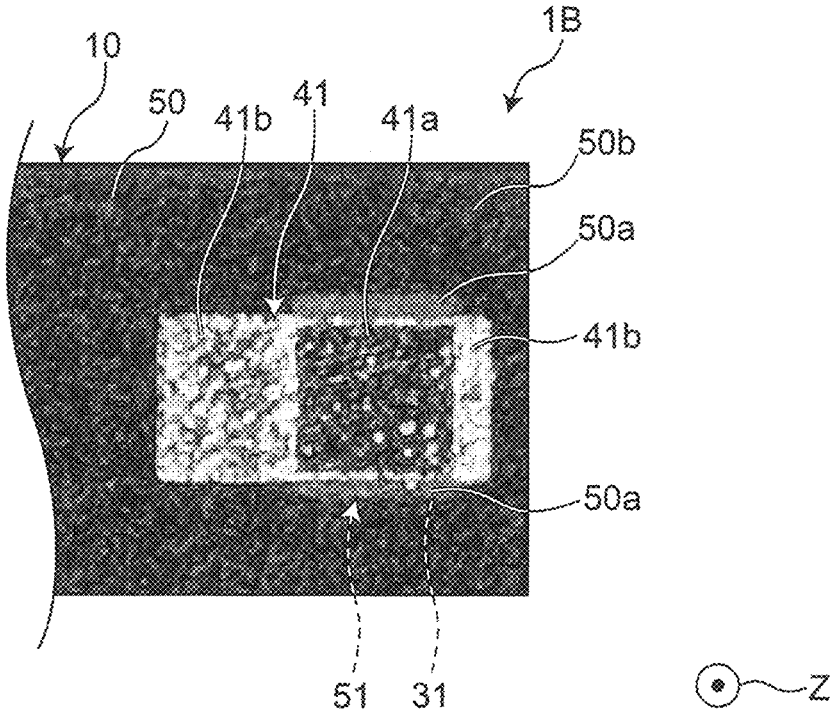
FIG. 9 is an image showing an Example of the third embodiment.

FIG. 9 shows an Example of the third embodiment (FIG. 6). As shown in FIG. 9, the overlapping portion 41*a* and the non-overlapping portion 41*b* in the first external terminal 41 exhibit different reflection spectra each other. Specifically, the size of the irregularities in the non-overlapping portion 41*b* is larger than the size of the irregularities in the overlapping portion 41*a*. Therefore, the overlapping portion 41*a* and the non-overlapping portion 41*b* differ in lightness and hue, and the overlapping portion 41*a* is darker than the non-overlapping portion 41*b*, so that the overlapping portion 41*a* and the non-overlapping portion 41*b* can be visually distinguished from each other. When they can be visually distinguished from each other as described above, they can be easily identified.

In the multilayer body 10 (the insulating coating 50), the overlapping portion 50*a* and the non-overlapping portion 50*b* exhibit different reflection spectra each other. Specifically, the overlapping portion 50*a* and the non-overlapping portion 50*b* differ in lightness and hue. Therefore, the overlapping portion 50*a* and the non-overlapping portion 50*b* can be visually distinguished from each other. When they can be visually distinguished from each other as described above, they can be easily identified. The first columnar wiring member 31 can be identified through the insulating coating 50. As described above, the first columnar wiring member 31 can be identified at a position directly below the first external terminal 41 and at a position directly below the insulating coating 50.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

a multilayer body including a magnetic layer;

an inductor wiring disposed inside the multilayer body; and an external terminal exposed from the multilayer body, wherein the external terminal has an overlapping portion which is on a top surface of the inductor wiring and a non-overlapping portion which is on a top surface of the magnetic layer, and a roughness of the overlapping portion differs from a roughness of the non-overlapping portion, such that reflection spectra of the overlapping region is different from reflection spectra of the non-overlapping region when irradiated with light having a prescribed wavelength from an outer surface side.

2. The inductor component according to claim 1, wherein the light having the prescribed wavelength is in the wavelength range of visible light.

3. The inductor component according to claim 1, wherein a size of irregularities on an outer surface of the overlapping portion differs from a size of irregularities on an outer surface of the non-overlapping portion.

4. The inductor component according to claim 3, wherein the size of the irregularities on the outer surface of the non-overlapping portion is larger than the size of the irregularities on the outer surface of the overlapping portion.

5. The inductor component according to claim 1, wherein the multilayer body further includes a non-magnetic insulating coating disposed on an outer surface of the magnetic layer and has:

a second overlapping portion that is part of the insulating coating that is disposed on the inductor wiring; and a second non-overlapping portion that is part of the insulating coating that is disposed on the magnetic layer.

6. The inductor component according to claim 5, wherein the inductor wiring can be identified through the insulating coating.

7. The inductor component according to claim 1, wherein the inductor wiring includes:

a spiral wiring member extending in a direction parallel to a principal surface of the magnetic layer; and a vertical wiring member that extends in a direction orthogonal to the principal surface of the magnetic layer and is connected to the spiral wiring member and to the external terminal.

8. The inductor component according to claim 1, wherein the vertical wiring member includes a columnar wiring member passing through the magnetic layer in a thickness direction thereof.

9. The inductor component according to claim 1, wherein the external terminal includes a plurality of conductive layers.

10. The inductor component according to claim 9, wherein one of the plurality of conductive layers that forms an outer surface contains Au or Sn.

11. The inductor component according to claim 9, wherein a first conductive layer among the plurality of conductive layers that is connected directly to the inductor wiring is formed of Cu or an alloy containing Cu as a main component.

12. The inductor component according to claim 11, wherein the first conductive layer contains Cu in an amount of about 95 wt % or more and Ni in an amount of from about 1 wt % to about 5 wt %.

13. The inductor component according to claim 9, wherein a first conductive layer among the plurality of conductive layers that is connected directly to the inductor wiring is formed of Ni or an alloy containing Ni as a main component.

14. The inductor component according to claim 1, wherein an outer surface of the overlapping portion of the external terminal has a recess located lower than an outer surface of the non-overlapping portion of the external terminal.

15. The inductor component according to claim 14, wherein the external terminal has a crack.

16. The inductor component according to claim 14, wherein when the thickness of the external terminal is set to 1, the depth of the recess is from about 0.05 to about 1.

17. The inductor component according to claim 1, wherein the magnetic layer contains a resin and a magnetic metal powder embedded in the resin.

18. The inductor component according to claim 17, wherein the magnetic layer further contains a ferrite powder.

19. The inductor component according to claim 1, wherein the inductor wiring is formed of Cu, Ag, Au, Fe, or a compound thereof.

20. An inductor component comprising:

a multilayer body including a magnetic layer;

an inductor wiring disposed inside the multilayer body; and an external terminal exposed from the multilayer body, wherein the external terminal has an overlapping portion which is disposed on the inductor wiring and a non-overlapping portion which is out of contact with the inductor wiring, and reflection spectra of the overlapping portion is different from reflection spectra of the non-overlapping portion when irradiated with light having a prescribed wavelength from an outer surface side, an outer surface of the overlapping portion of the external terminal has a recess located lower than an outer surface of the non-overlapping portion of the external terminal, and the external terminal has a crack.

* * * * *